United States Patent [19]

Hsu

[11] Patent Number: 4,509,348

[45] Date of Patent: Apr. 9, 1985

[54] DEVICE FOR AUTOMATIC LOCK

[76] Inventor: S. P. Hsu, No. 8, Lane 232, Line-sen Rd., Hu-wei, Yunlin Hsien, Taiwan

[21] Appl. No.: 420,118

[22] Filed: Sep. 20, 1982

[51] Int. Cl.[3] ..... E05B 63/12

[52] U.S. Cl. ..... 70/131; 70/127

[58] Field of Search ..... 70/131, 129, 125, 127, 70/134, DIG. 79; 292/DIG. 60, 59

[56] References Cited

U.S. PATENT DOCUMENTS

| | | | |
|---|---|---|---|
| 1,593,684 | 7/1926 | Anakin | 70/DIG. 79 X |
| 1,613,398 | 1/1927 | Ledin | 70/131 X |
| 1,613,566 | 1/1927 | Braunig | 70/131 X |
| 1,725,543 | 8/1929 | Segal | 70/131 X |
| 1,790,422 | 1/1931 | Holtzman | 70/DIG. 79 X |
| 1,923,443 | 8/1933 | Knieszner | 70/DIG. 79 X |
| 4,053,177 | 10/1977 | Stammreich et al. | 292/DIG. 60 X |
| 4,066,284 | 1/1978 | Ikemura | 292/DIG. 60 X |
| 4,072,333 | 2/1978 | Hutter | 292/DIG. 60 X |
| 4,086,794 | 5/1978 | Richards | 70/134 |

*Primary Examiner*—Gary L. Smith
*Assistant Examiner*—Russell W. Illich
*Attorney, Agent, or Firm*—Tak K. Sung

[57] ABSTRACT

A new lock wherein during locking, the lock latch is moved horizontally into a socket and rotated therein so as to hook up the socket housing, thus reinforcing the lock, and the pins in the lock cylinder are designed to be adjustable in order to fit for some keys with special shapes; furthermore, the cylinder spindle is covered with a sleeve to strengthen the locking function.

2 Claims, 6 Drawing Figures

DEVICE FOR AUTOMATIC LOCK

BACKGROUND OF THE INVENTION

This invention relates to a new lock, particularly to one in which the lock latch can be rotated through an angle and the pins in the cylinder of the lock are adjustable in order to suit the notches in a key.

As shown in FIG. 1, the lock has a conventional lock bolt which can extend into the door jamb, a handle is set on one side of the door and is provided with a thumb knob. When it is desired to lock the door, the thumb knob is pushed in. But this kind of lock can be pried or jimmied open easily using hand tools. Thus, this type of lock provides little security. In order to overcome the disadvantages of the above-mentioned lock dead-bolt locks, as shown in B of FIG. 1, appeared in the market. This type of lock is equipped with a dead bolt 2020 and spring bolt 2010. Dead bolt 2020 is designed to have two stages of displacements, which means that any throw or retraction of bolt 2020 requires two rotations of the key. The keyhole 2030 is located outside and inside the door. Therefore, the lock can be locked or unlocked with a key from either side of the door. Inside the lock, there is a locating plate which is used to stop and fix the dead bolt during every stage of displacement. The better antitheft effect of a dead bolt lock has made it more popular, but there are still possibilities of being pried or jimmied open because the movement of its dead bolt is made only in either left or right direction. Besides, in daily life we have a lot of chances to use lock for security purposes, such as front door, rooms, drawers, cars, etc. As each lock can be unlocked only by a specific key, people always have to carry a lot of keys. In this case, keys become a burden to people and it is also inconvenient for people to have to find the correct key.

SUMMARY OF THE INVENTION

It is an object of the present invention to provide a lock which is equipped with a special activating mechanism and a bolt different from conventional ones; the actuating mechanism can cause the bolt to turn a certain angle as the lock is being activated. Therefore, in locking, the bolt not only moves forward but also turns a certain angle to hook up a socket. As a result, it provides improved security and eliminates the possibility of being pried or jimmied open.

According to another embodiment of the present invention, the pins in the cylinder are adjustable so that different types of locks can be opened using the same key to eliminate the trouble and inconveniences caused by carrying too many keys. This is the another object of the present invention.

According to a further embodiment of the present invention, the cylinder spindle is covered with a sleeve, so as to avoid and prevent the lock from being pried or jimmied open to improve security.

The invention will be further described by way of example with references to the accompanying drawings, wherein

DETAILED DESCRIPTION OF THE INVENTION

Figure 1:
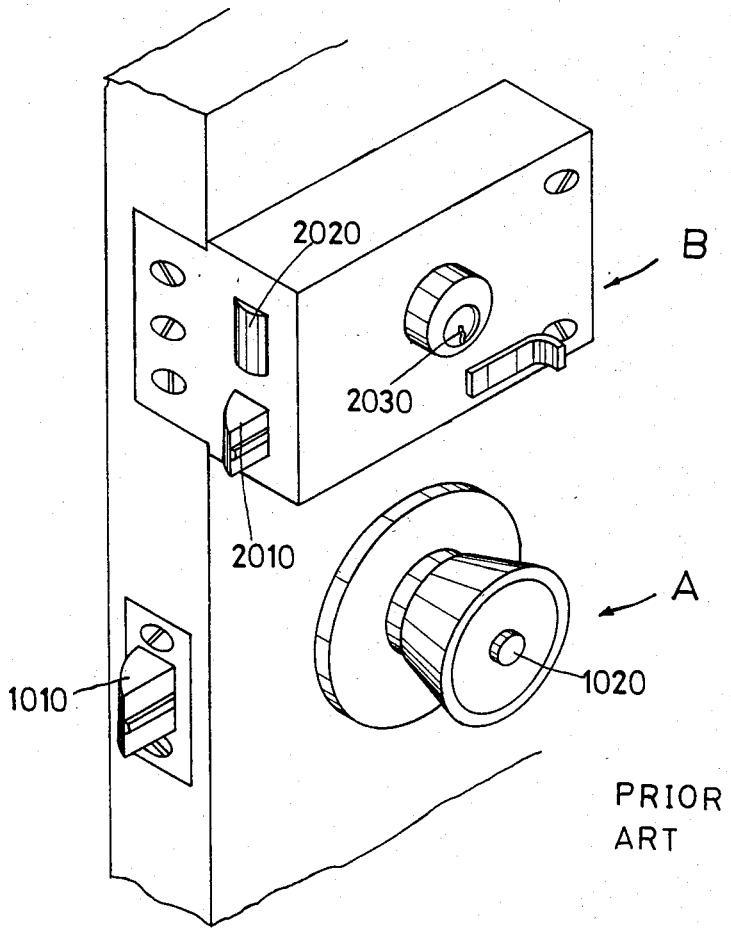
FIG. 1 is a plan view showing a conventional lock and a dead bolt lock.
Figure 2:
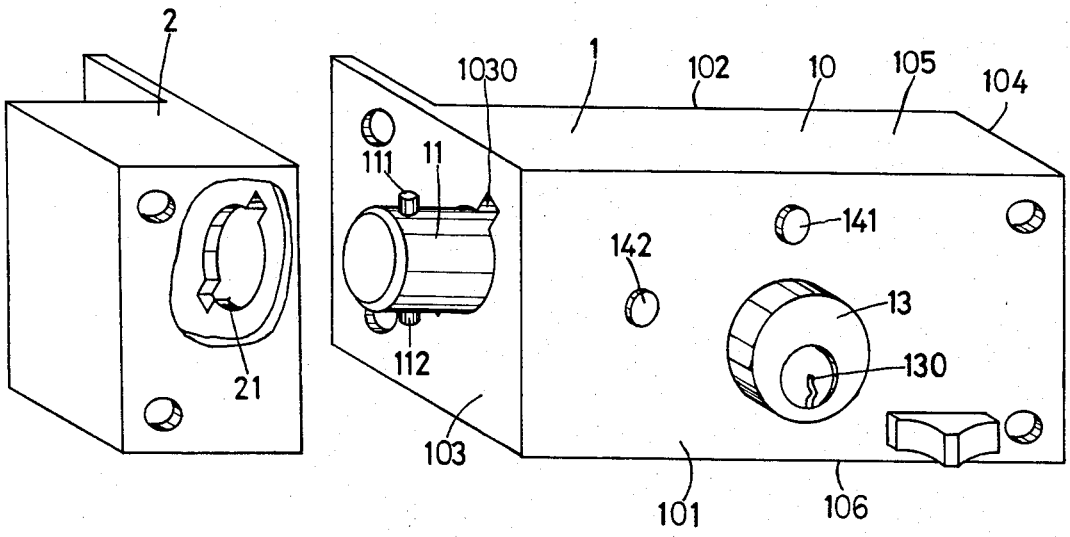
FIG. 2 is a plan view showing the two parts of the lock of the present invention.
Figure 3:
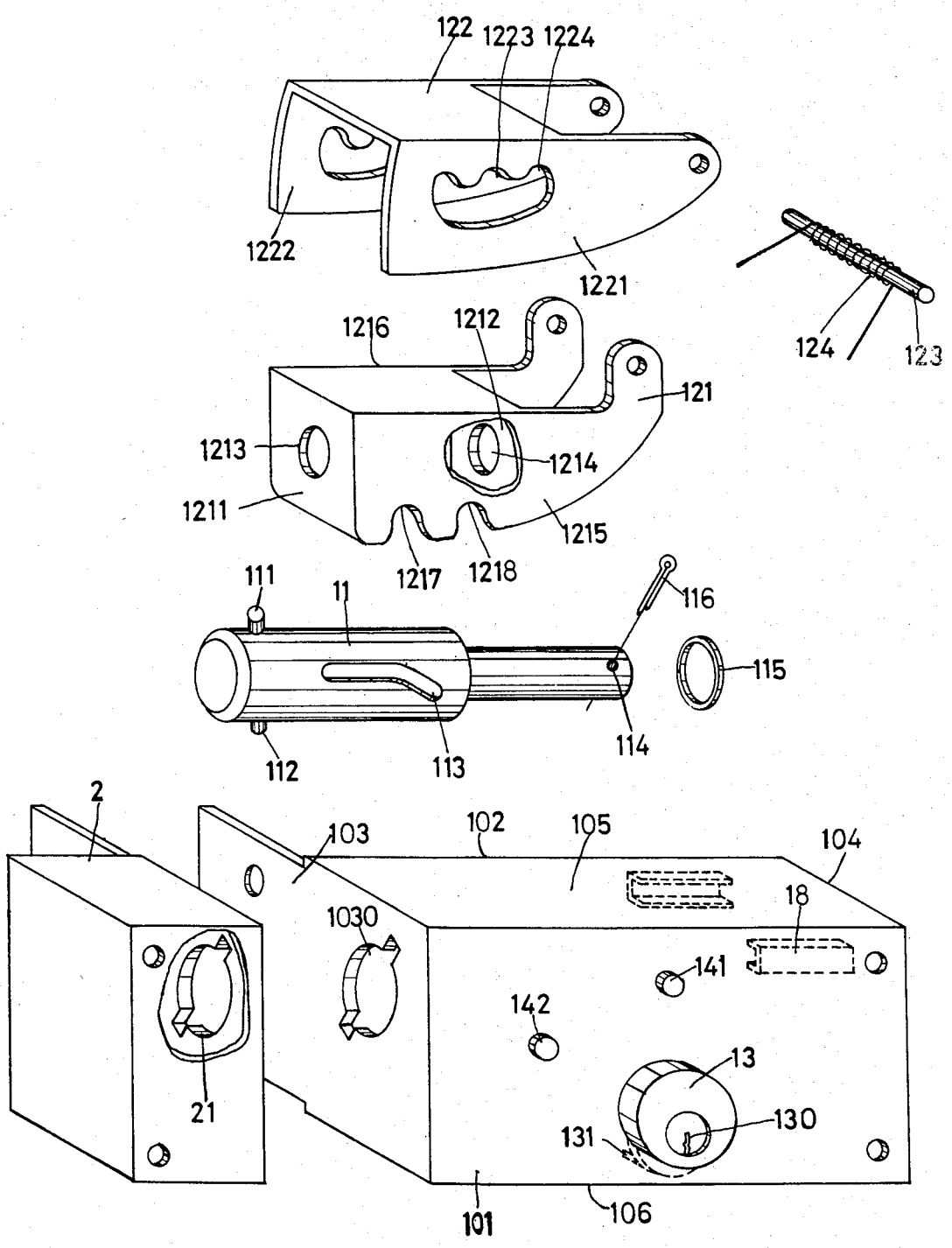
FIG. 3 shows the individual parts of the combination of the present invention.

With reference to FIGS. 2 and 3, the automatic lock of the present invention comprises a lock body 1 and a socket 2, which are installed in the door stile and door jamb, respectively. The lock body 1 has housing 10 comprising a front plate 101, a back plate 102, a left plate 103, a right plate 104, a top plate 105 and a bottom plate 106. Inside the housing 10 on the front plate 101 and the back plate 102, there is a pair of guide grooves 18; a lock cylinder 13 is disposed in the lower central portion of the front plate 101, a locating plunger 141 is set at the upper portion of the cylinder 13, a fixing rod 142 is provided near the front portion of the front plate 101, and a lockbolt hole 1030 is formed on the left plate 103 of the housing 10. Inside the housing 10, there is an activating mechanism 12 and lug 11 partially extending from the activating mechanism 12. The activating mechanism 12 is made up of a movable bracket 121 and a multi-stage locating plate 122 straddling the movable bracket 121, and both of them are hingedly connected at the rear ends by a pin 123, to which is attached a spring 124 for biasing the movable bracket toward the multi-stage locating plate. The holes 1213, 1214 are aligned and are set at the front and back vertical plates 1211, 1212, respectively, of the movable bracket 121. On the bottom edges at the left and right vertical plates 1215, 1216 of the movable bracket are formed upward driving slots 1217, 1218, respectively. On each of the downward-extending plates 1221, 1222 of the multi-stage locating plate 122, there is a multi-notch locating hole 1223, 1224. The lug 11 is divided into two sections each having different diameters, with the diameter of the front section being bigger. Further, two projections 111 and 112 protrude from either side of the lug. Curved slot 113 is formed on the surface of the lug 11. Near the rear end of its back section, there is pin hole 114. When the back section of the lug goes through the aligned holes 1213, 1214 of the front and back vertical plates 1211, 1212 of the movable bracket 121 of the said activating mechanism 12, a retaining ring 115 is sleeved onto the rear end of the lug, and then, a pin 116 is inserted into the pin hole 114 located at the rear end of the locklatch to fix the lug 11 together with the activating mechanism 12.

Near the center of the lock cylinder 13, there is a keyhole 130, and on its edge, there is also a cam plug 131A. Since the inner structure of the cylinder has another function, it will be described later.

Figure 4:
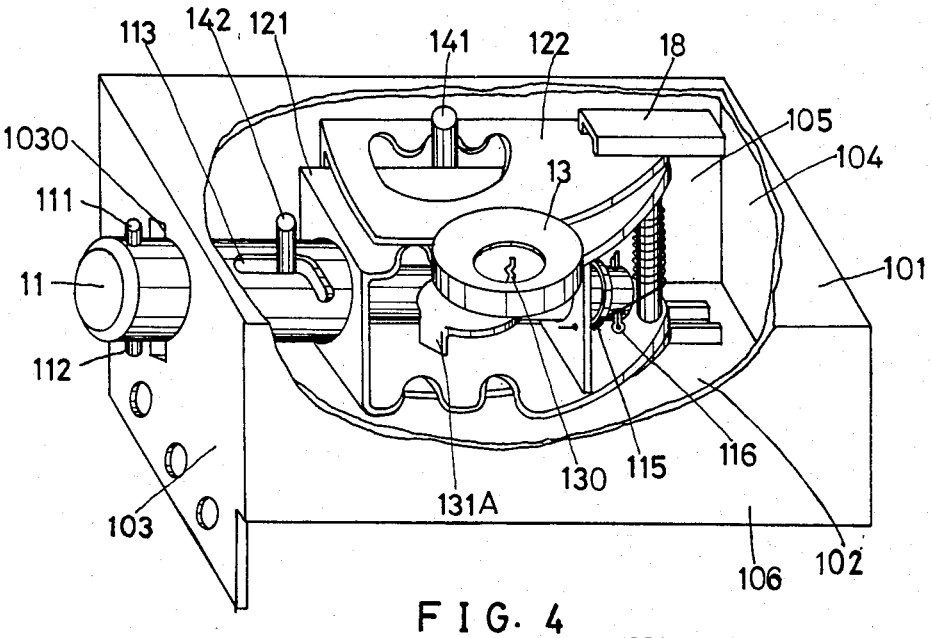
FIG. 4 shows the inner structure of the present invention.

Referring to FIG. 4, after the lock of the present invention has been assembled, the fixing rod 142 on the housing 10 is inserted into the curved slot 113 of the lug 11, the locating plunger 141 is then extended into the locating holes 1223, 1224 of the locating plate 122 of the activating mechanism 12, and the guide bracket 18 at the inner wall of the housing's 10 will accept the pin 123 of the activating mechanism 12.

The socket 2 corresponding to the lock body 1 is also in a case form and it has a keyhole 21 at its side.

In using the present invention, to lock the door, a key is inserted into the keyhole 130 of the spindle of the lock cylinder and turned. The cam plug 131A of the cylinder is turned and enters the driving notches 1217, 1218 formed at the bottom edges of the movable bracket 121 of the vertical plates of the activating mechanism 12, that is, notches 1217, 1218 cause the activating mechanism 12 to move forward. In the meantime, the locating plunger 141 of the housing 10 moves to the end of the locating holes 1223, 1224, and the fixing rod 142 also moves backward in the curve slot 113 of the lug 11. After rotating the key for two turns, the lug 11 extends outward to pass over the lug hole 21 of the socket 2 and enter thereinto. In addition, the fixing rod 142 enters the bent section of the curved slot 113 in lug 11. In this case, the lug 11 rotates through a certain angle to complete the locking function.

Figure 5:
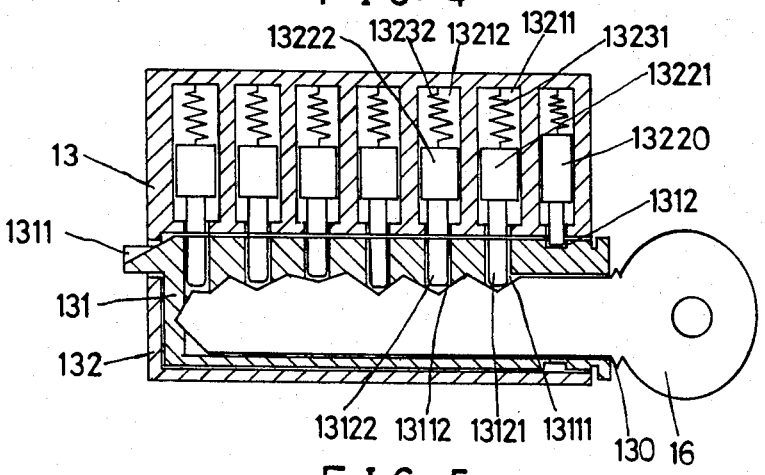
FIG. 5 shows a sectional view of the cylinder of the present invention.

As shown in FIG. 5, the cylinder of the present invention is composed of a cylinder spindle 131 and a cylindrical barrel 132, in which, the cylinder spindle 131 is either in two-section or one-section having a keyhole 130 and its rear end forms a oblique tenon 1311; at one end of the cylinder spindle 131 is set a pin groove 1312, and at the side surface of the cylinder spindle 131 there is a row of pin holes 13111,13112 all of which are connected to the keyhole 130. The pins 13121, 13122, are separately put into the corresponding pin holes 13111, 13112, and the cylinder spindle 131 is set in the cylindrical barrel 132; the surface of the cylindrical barrel 132 also has a row of pin holes 13211, 13212. The opening of each pin hole is formed at the inner wall of cylindrical barrel 132, and the outer diameter of each opening rim is smaller than the diameter of the pin hole. In order to match the pin holes 13211, 13212 formed in the cylindrical barrel, the upper row of the pins 13221, 13222 in the cylindrical barrel 132 are made to have upper sections larger than lower sections, and after the upper row of pins 13221, 13222 are put into the pin holes 13211, 13212 in the cylindrical barrel 132, the springs 13231, 13232 are then put into the pin holes to press the upper row of pins 13221, 13222 and make their lower ends in smaller diameter protrude out of the pin holes 13211, 13212 Besides, a pin 13220 is inserted in the fixing pin groove 1312 formed at one end of the cylinder spindle 131 to join the cylindrical barrel 132 and the cylinder spindle 131 to form a unit.

Figure 6:
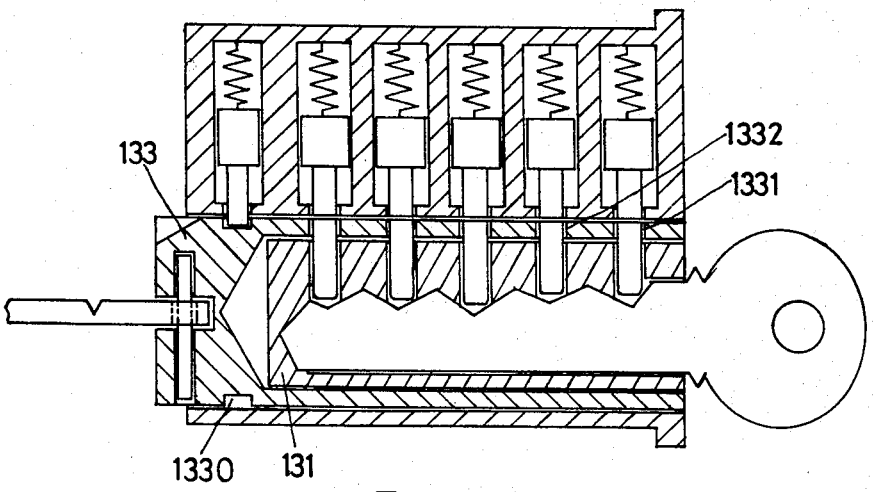
FIG. 6 shows a sectional view of another example of the cylinder of the present invention.

With reference to FIG. 6, outside the cylinder spindle 131 of the present invention, there is also a sleeve 133. After the cylinder spindle 131 has been inserted into the sleeve 133, both of them are put into the cylindrical barrel 132. The surface of the sleeve 133 also has a row of thru-holes 1331, 1332, and a pin groove 1330. When locking, the pins 13221, 13222 in the cylindrical barrel 132 go through the thru-holes 1331, 1332 of the sleeve and then extends into the pin holes 13111, 13112 of the cylinder spindle 131. When unlocking, the pins 13221, 13222 inside the cylindrical barrel 132 are retracted outside the surface of the sleeve 133 as shown in the FIG. 6.

The corresponding key used in the said lock cylinder is optional. For example, when making a key to fit locks which are used for room, cabinet and the like, the lock cylinder is formed as follows. First, insert the key 16 into the keyhole 130; then put the pins 13121, 13122 into the pin holes 13111 of the cylinder spindle 131 respectively until the tops of pins 13121, 13122 are at the same height with the openings of the pin holes 13111, 13112. Then, insert the cylinder spindle 131 with the key 16 are inserted into the cylinder barrel 132. The oblique tenon 1311 at the rear end of the cylinder spindle 131, pushes the pins 13221, 13222 of the cylindrical barrel 132 into the pin holes 13211, 13212 while the cylinder spindle 131 remains inserted into the cylindrical barrel 132. In this respect, the fixing pin 13220 can be inserted into the fixing pin groove 1312 at one end of the cylinder spindle 131; the cylindrical barrel 132 and the cylinder spindle 131 are unified as a whole unit. As a result, the proper key is formed.

The lock of the present invention provides excellent security and eliminates the problems of carrying a lot of keys. The design that the cylinder spindle is covered with a sleeve is also suitable for conventional lock sets and it reinforces the locking functions.

I claim:

1. A lock comprising a housing having disposed therein an activating mechanism comprising a movable bracket and a multistage locating plate straddling said movable bracket, said locating plate and movable bracket being hingedly connected at one end by means of a pin, a spring means being used to urge said movable bracket toward from said multistage locating plate, said pin being placed between guide tracks provided on the interior walls of said housing to allow lateral movement of said activating mechanism, a laterally movable lug being disposed within said movable bracket so that in a retracted position said lug is disposed within said housing and in an extended position, said lug extends out of said housing to enter a socket disposed adjacent said housing, said lug being provided with a bent slot through which a fixing rod extends so that when said lug is in its fully extended position, said fixing rod causes said lug to rotate, said movable bracket and said multistage locating plate being provided with notches to engage a cam plug activatable by a key to permit selected lateral movement of said activating mechanism when the key is turned.

2. The lock of claim 1 wherein the free end of the lug is provided with a plurality of projections.

* * * * *